US006401725B1

(12) United States Patent
Beal

(10) Patent No.: US 6,401,725 B1
(45) Date of Patent: Jun. 11, 2002

(54) HAIR CURLING DEVICE

(76) Inventor: Albert Beal, 14 Madison St., Wayne, NJ (US) 07470

( * ) Notice: Subject to any disclaimer, the term of this patent is extended or adjusted under 35 U.S.C. 154(b) by 0 days.

(21) Appl. No.: 09/933,399

(22) Filed: Aug. 20, 2001

(51) Int. Cl.[7] ..... A45D 2/14; A45D 2/00; A45D 2/08

(52) U.S. Cl. ..... 132/248; 132/245; 132/250

(58) Field of Search ..... 132/248, 245, 132/246, 250, 259, 268, 253, 256

(56) References Cited

U.S. PATENT DOCUMENTS 4,216,787 A * 8/1980 Moea ..... 132/245
4,465,085 A * 8/1984 Schopieray ..... 132/250
4,572,221 A * 2/1986 Barradas ..... 132/250
4,809,719 A * 3/1989 Holman ..... 132/250
5,193,558 A * 3/1993 Squatrito ..... 132/250
5,201,329 A * 4/1993 Quackenbush ..... 132/248
5,558,107 A * 9/1996 Kim ..... 132/228
5,791,356 A * 8/1998 Muzzipapa ..... 132/250

* cited by examiner

*Primary Examiner*—John J. Wilson
*Assistant Examiner*—Robyn Kieu Doan
(74) *Attorney, Agent, or Firm*—Goldstein & Lavas, P.C.

(57) ABSTRACT

A hair curling device including a cylindrical portion having a central portion and opposed end portions. The central portion has a plurality of apertures' therethrough. A pair of cylindrical end caps are secured to the opposed end portion of the cylindrical portion. Each of the end caps have an inner surface, an outer surface, and an intermediate periphery therebetween. One of the intermediate periphery's has an aperture therethrough and another intermediate periphery has a protrusion extending outwardly therefrom. An elastic band extends across the cylindrical portion and the pair of end caps.

4 Claims, 2 Drawing Sheets

HAIR CURLING DEVICE

BACKGROUND OF THE INVENTION

The present invention relates to a hair curling device and more particularly pertains to curling multiple waves of hair into a single strand of hair.

The use of hair treatment devices is known in the prior art. More specifically, hair treatment devices heretofore devised and utilized for the purpose of curling hair are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,108,183 to Mauro discloses a hair curler device comprised of two different radius cylindrical cores, capable of curling a single hair in two sizes or diameters of curls. U.S. Pat. No. 4,732,169 to Van Sickle discloses a permanent wave roller comprised of a rod with a plurality of apertures. U.S. Pat. No. 1,345,040 to Vandamark discloses a curler.

While these devices fulfill their respective, particular objective and requirements, the aforementioned patents do not describe a hair curling device for curling multiple waves of hair into a single strand of hair.

In this respect, the hair curling device according to the present invention substantially departs from the conventional concepts and designs of the prior art, and in doing so provides an apparatus primarily developed for the purpose of curling multiple waves of hair into a single strand of hair.

Therefore, it can be appreciated that there exists a continuing need for a new and improved hair curling device which can be used for curling multiple waves of hair into a single strand of hair. In this regard, the present invention substantially fulfills this need.

SUMMARY OF THE INVENTION

In the view of the foregoing disadvantages inherent in the known types of hair treatment devices now present in the prior art, the present invention provides an improved hair curling device. As such, the general purpose of the present invention, which will be described subsequently in greater detail, is to provide a new and improved hair curling device which has all the advantages of the prior art and none of the disadvantages.

To attain this, the present invention essentially comprises a cylindrical portion having a central portion and opposed end portions. The central portion has a plurality of apertures' therethrough. A pair of cylindrical end caps are secured to the opposed end portion of the cylindrical portion. Each of the end caps have an inner surface, an outer surface, and an intermediate periphery therebetween. The outer surfaces each have a lateral recess formed therein. One of the intermediate periphery's has an aperture therethrough and another intermediate periphery has a protrusion extending outwardly therefrom. An elastic band extends across the cylindrical portion and the pair of end caps. The elastic band has opposed free ends. The opposed free ends each have a nodule disposed thereon. The nodules are receivable within the lateral recesses of the outer surfaces of the end caps.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved hair curling device which has all the advantages of the prior art hair treatment devices and none of the disadvantages.

It is another object of the present invention to provide a new and improved hair curling device which may be easily and efficiently manufactured and marketed.

It is a further object of the present invention to provide a new and improved hair curling device which is of durable and reliable construction.

An even further object of the present invention is to provide a new and improved hair curling device which is susceptible of a low cost of manufacture with regard to both materials and labor, and which accordingly is then susceptible of low prices of sale to the consuming public, thereby making such a hair curling device economically available to the buying public.

Even still another object of the present invention is to provide a new and improved hair curling device for curling multiple waves of hair into a single strand of hair.

Lastly, it is an object of the present invention to provide a new and improved hair curling device including a cylindrical portion having a central portion and opposed end portions. The central portion has a plurality of apertures' therethrough. A pair of cylindrical end caps are secured to the opposed end portion of the cylindrical portion. Each of the end caps have an inner surface, an outer surface, and an intermediate periphery therebetween. One of the intermediate periphery's has an aperture therethrough and another intermediate periphery has a protrusion extending outwardly therefrom. An elastic band extends across the cylindrical portion and the pair of end caps.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
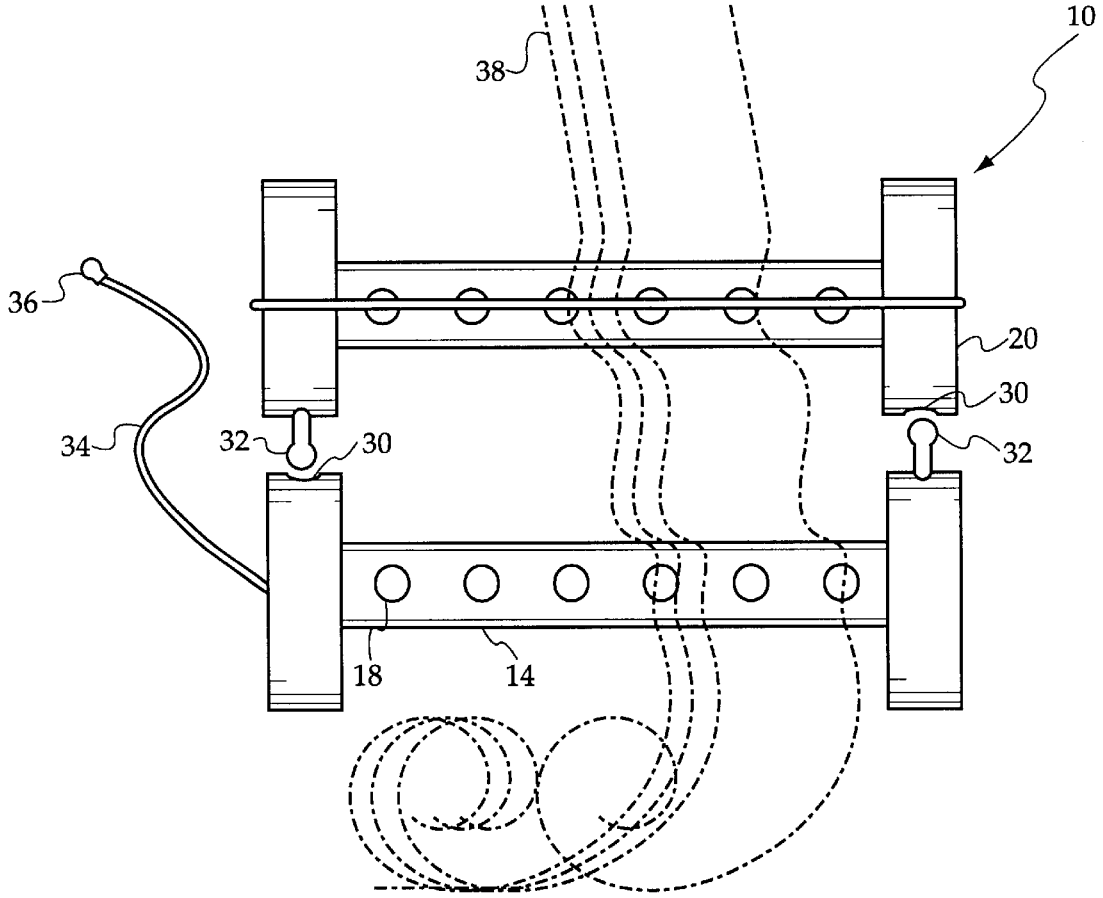
FIG. 1 is a front view of the present invention illustrated in use.
Figure 2:
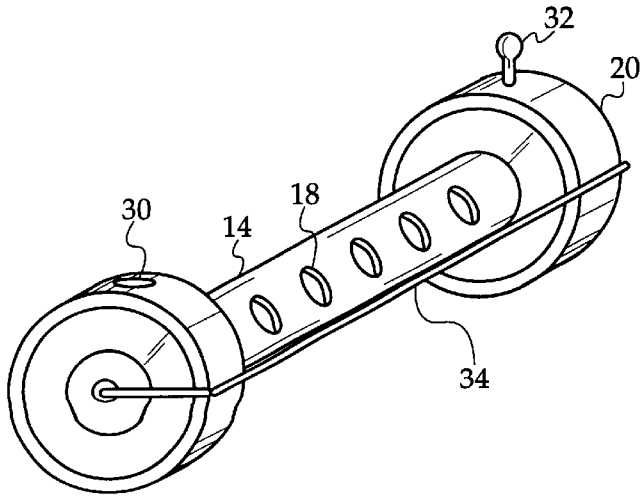
FIG. 2 is a perspective view of the preferred embodiment of the hair curling device constructed in accordance with the principles of the present invention.
Figure 3:
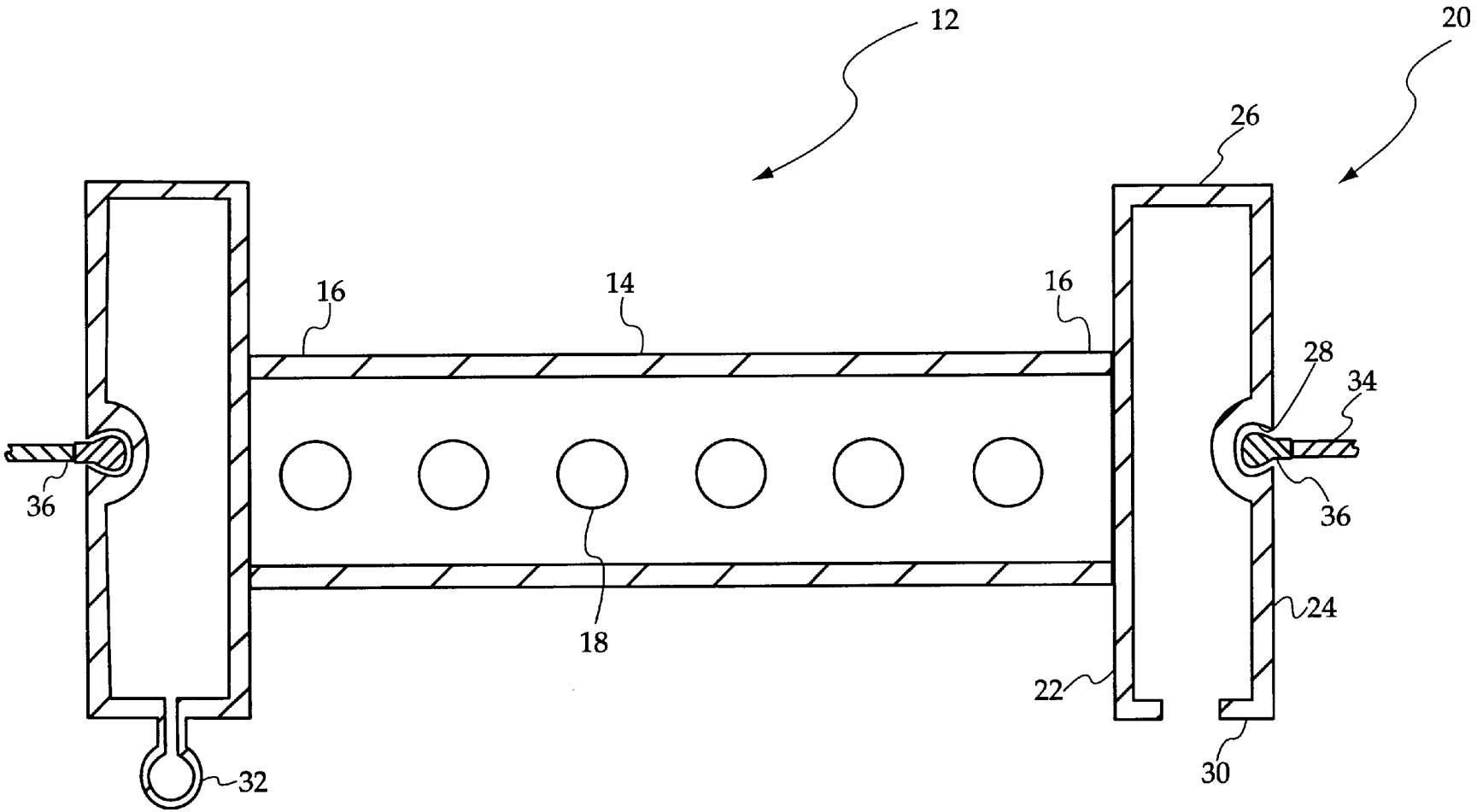
FIG. 3 is a cross-sectional side view of the present invention.

With reference now to the drawings, and in particular, to FIGS. 1 through 3 thereof, the preferred embodiment of the new and improved hair curling device embodying the principles and concepts of the present invention and generally designated by the reference number 10 will be described.

Specifically, it will be noted in the various Figures that the device relates to a hair curling device for curling multiple waves of hair into a single strand of hair. In its broadest context, the device consists of a cylindrical portion, a pair of cylindrical end caps, and an elastic band. Such components are individually configured and correlated with respect to each other so as to attain the desired objective.

The cylindrical portion 12 has a central portion 14 and opposed end portions 16. The central portion 12 has a plurality of holes 18 extending transversely therethrough.

The pair of cylindrical end caps 20 are secured to the opposed end portions 16 of the central portion 14. Each of the end caps 20 have an inner surface 22, an outer surface 24, and an intermediate periphery 26 therebetween. The outer surfaces 24 each have a lateral recess 28 formed therein. The intermediate periphery 26 of one of the end caps 20 has an aperture 30 therethrough and the intermediate periphery 26 of the other end cap 20 has a protrusion 32 extending outwardly therefrom, perpendicular to said intermediate portion so that the protrusion 32 is sized to fit in the aperture 30 of the other end cap 20.

The elastic band 34 extends across the cylindrical portion 12 and the pair of end caps 20. The elastic band 34 has opposed free ends. The opposed free ends each have a nodule 36 disposed thereon. The nodules 36 are receivable within the lateral recesses 28 of the outer surfaces 24 of the end caps 20.

In use, a wave of hairs 38 is positioned against the central portion 14 of a first device. The elastic band 34 is then extended over the wave of hairs 38 with the nodules 36 positioned within the recess 28 to contain the wave of hairs 38 against the central portion 14. Subsequently, a next device is then positioned against and alongside the first device, with the central portions 14 thereof extending parallel to each other, with the protrusion 32 of the first device extending into the aperture 30 of the next device and the protrusion 32 of the next device is positioned in and mated with the aperture 30 of the first device to link the first and next device. The wave of hairs 38 is then positioned against the central portion 14 of the next device and the elastic band 34 is engaged to the end caps 20. Note FIG. 1. This process will continue until an entire length of the wave of hairs 38 is covered.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A hair curling device for curling multiple waves of hair into a single strand of hair comprising, in combination:

a cylindrical portion having a central portion and opposed end portions, the central portion having a plurality of holes therethrough;

a pair of cylindrical end caps secured to the opposed end portions of the cylindrical portion, each of the end caps having an inner surface, an outer surface, and an intermediate periphery therebetween, the outer surfaces each having a lateral recess formed therein, the intermediate periphery of one of the end caps having an aperture therethrough and the intermediate periphery of the other of the end caps having a protrusion extending outwardly therefrom which is sized to fit directly within the aperture of the other of the end caps, such that when the hair curling device is positioned alongside another hair curling device as described, the protrusions can be mated with the apertures of the other hair curling device; and an elastic band extending across the cylindrical portion and the pair of end caps, the elastic band having opposed free ends, the opposed free ends each having a nodule disposed thereon, the nodules being receivable within the lateral recesses of the outer surfaces of the end caps.

2. A hair curling device for curling multiple waves of hair into a single strand of hair comprising, in combination:

a cylindrical portion having a central portion and opposed end portions, the central portion having a plurality of holes therethrough;

a pair of cylindrical end caps secured to the opposed end portions of the cylindrical portion, each of the end caps having an inner surface, an outer surface, and an intermediate periphery therebetween, the intermediate periphery of one of the end caps having an aperture therethrough and the intermediate periphery of the other of the end caps having a protrusion extending outwardly therefrom which is sized to fit directly within the aperture of the other of the end caps, such that when the hair curling device is positioned alongside another hair curling device as described, the protrusions can be mated with the apertures of the other hair curling device; and an elastic band extending across the cylindrical portion and the pair of end caps.

3. The hair curling device as set forth in claim 2, wherein the elastic band has opposed free ends, the opposed free ends each having a nodule disposed thereon, the nodules being couplable with the outer surfaces of the end caps.

4. The hair curling device as set forth in claim 3, the outer surfaces of the end caps have recessed formed therein for receiving the nodules therein.

* * * * *